US010591239B2

(12) United States Patent
Tubb

(10) Patent No.: US 10,591,239 B2
(45) Date of Patent: Mar. 17, 2020

(54) MODULAR PRECISION RIFLE ASSEMBLY AND METHOD FOR CONFIGURING RIFLE COMPONENTS AND ACCESSORIES

(71) Applicant: G. David Tubb, Canadian, TX (US)

(72) Inventor: G. David Tubb, Canadian, TX (US)

( * ) Notice: Subject to any disclaimer, the term of this patent is extended or adjusted under 35 U.S.C. 154(b) by 0 days.

(21) Appl. No.: 16/253,169

(22) Filed: Jan. 21, 2019

(65) Prior Publication Data

US 2019/0257615 A1 Aug. 22, 2019

Related U.S. Application Data

(63) Continuation of application No. 15/224,646, filed on Jul. 31, 2016, now Pat. No. 10,184,752.

(60) Provisional application No. 62/199,139, filed on Jul. 30, 2015, provisional application No. 62/274,054, filed on Dec. 31, 2015.

(51) Int. Cl.

| | |
|---|---|
| ***F41A 21/48*** | (2006.01) |
| ***F41C 23/16*** | (2006.01) |
| ***F41A 21/44*** | (2006.01) |

(52) U.S. Cl.

CPC ..... *F41A 21/48* (2013.01); *F41A 21/44* (2013.01); *F41C 23/16* (2013.01)

(58) Field of Classification Search

CPC ..... F41A 21/48; F41A 21/482; F41A 21/487; F41A 11/00; F41A 11/02; F41A 3/00; F41A 3/12; F41A 3/64; F41A 3/66; F41A 3/68

See application file for complete search history.

(56) References Cited

U.S. PATENT DOCUMENTS

| | | | | | |
|---|---|---|---|---|---|
| 529,455 | A | * | 11/1894 | Marlin | F41A 21/481 42/75.02 |
| 1,355,422 | A | * | 10/1920 | Pedersen | F41A 21/12 42/78 |
| 2,297,693 | A | * | 10/1942 | Dicke | F41A 3/26 89/180 |
| 2,747,313 | A | * | 5/1956 | Crittendon | F41A 21/482 42/75.02 |
| 3,027,672 | A | * | 4/1962 | Sullivan | F41A 21/12 42/16 |
| 3,877,167 | A | * | 4/1975 | Keppeler | F41A 21/482 42/75.02 |

(Continued)

*Primary Examiner* — Derrick R Morgan

(74) *Attorney, Agent, or Firm* — J. Andrew McKinney, Jr.; McKinney & Associates, LLC

(57) ABSTRACT

A modular precision rifle assembly 150 and a method for configuring rifle components allowing users to change barrel subassemblies 214 (i.e., for a replacement barrel for use with the same ammunition or a barrel configured for shooting a different ammunition caliber or type) includes three main components including a receiver subassembly 212, a barrel subassembly 214 and a forend subassembly 200. The receiver subassembly 212 includes a receiver housing 300 with a central lumen defining a plurality of substantially cylindrical contiguous cavities aligned along a central axis 300CA. The barrel assembly's bore is automatically forced into axial alignment with central axis 300CA when a user tightens a barrel coupler nut 500 against a barrel extension 400 due to the centering force generated when the extension's centering surface 410 bears against the coupler nut's cooperating centering surface 520.

9 Claims, 16 Drawing Sheets

(56) References Cited

U.S. PATENT DOCUMENTS 4,019,423 A * 4/1977 Johnson ..... F41A 3/62 89/178
4,791,748 A * 12/1988 Leskinen ..... F41A 3/66 42/75.02
5,479,737 A * 1/1996 Osborne ..... F41A 21/12 42/76.01
5,970,879 A * 10/1999 Jamison ..... F41A 3/18 102/464
6,250,007 B1 * 6/2001 Payne ..... A22B 3/02 42/1.12
6,609,323 B1 * 8/2003 Donnelly ..... F41A 3/76 42/59
7,076,904 B1 * 7/2006 Rustick ..... F41A 21/482 42/75.01
7,628,149 B1 * 12/2009 Zarecky ..... F41A 21/04 124/58
9,057,576 B2 * 6/2015 Barrett ..... F41A 3/66
9,383,154 B2 * 7/2016 Stone ..... F41A 21/481
9,383,155 B2 * 7/2016 Bero ..... F41A 3/66
9,506,712 B2 * 11/2016 Mather ..... F41A 21/482
9,719,746 B1 * 8/2017 Lyman ..... F41A 21/482
2004/0244256 A1 * 12/2004 Ramirez ..... F41A 21/12 42/76.01
2005/0193615 A1 * 9/2005 Hengstenberg ..... F41A 21/12 42/51
2010/0175290 A1 * 7/2010 Duplessis ..... F41A 3/22 42/16
2011/0126443 A1 * 6/2011 Sirois ..... F41C 23/16 42/90
2012/0216439 A1 * 8/2012 Barrett ..... F41A 3/26 42/75.02
2013/0291420 A1 * 11/2013 Aalto ..... F41A 21/48 42/75.02
2014/0115938 A1 * 5/2014 Jarboe ..... F41A 21/485 42/71.01
2015/0168092 A1 * 6/2015 Stone ..... F41A 21/481 42/76.01
2016/0010938 A1 * 1/2016 Merkley ..... F41A 21/482 42/75.02
2016/0116251 A1 * 4/2016 Mather ..... F41A 21/482 42/71.01
2016/0209155 A1 * 7/2016 Dodson ..... F41A 21/12
2016/0313081 A1 * 10/2016 Stone ..... F41A 21/481
2017/0184368 A1 * 6/2017 Cheng ..... F41A 21/485
2018/0128567 A1 * 5/2018 Foster ..... F41A 21/482
2018/0283821 A1 * 10/2018 Dodson ..... F41A 21/02
2019/0086175 A1 * 3/2019 Karagias ..... F41A 21/482
2019/0178598 A1 * 6/2019 McMillan ..... F41A 21/48
2019/0249944 A1 * 8/2019 Vabnick ..... F41B 9/0046
2019/0257615 A1 * 8/2019 Tubb ..... F41A 21/44

* cited by examiner

MODULAR PRECISION RIFLE ASSEMBLY AND METHOD FOR CONFIGURING RIFLE COMPONENTS AND ACCESSORIES

PRIORITY CLAIMS AND RELATED APPLICATION INFORMATION

This application is related to and claims priority to:

(a) commonly owned and co-pending U.S. utility patent application Ser. No. 15/224,646, entitled "Improved Firearm Accessory Mounting Interface, Mirage Shield and Ergonomic Method for Configuring Rifle Components and Accessories", which was filed on Sunday, Jul. 31, 2016, and claimed priority to:

(b) provisional application 62/199,139, which was filed on Jul. 30, 2015, and (c) provisional application 62/274,054, entitled "Improved, Modular T15 Precision Rifle Assembly and Method", which was filed on Dec. 31, 2015, the entire disclosures of which are all incorporated herein by reference.

BACKGROUND OF THE INVENTION

Field of the Invention

The present invention relates to rifle construction, modular precision firearm assemblies and more particularly relates to precision rifle assemblies and methods for configuring a rifle with a modular structure for use with changeable barrels in multiple calibers or for use with different types of ammunition.

Discussion of the Prior Art

It is well known to those skilled in the art that firearms such as precision rifles and military rifles (e.g., M110 Semi-Automatic Sniper System type rifles) when in use, are characterized by the heating of the barrels to relatively high temperatures. With frequent firing at the expected rate of fire (e.g., 24 rounds per minute), high temperatures can be sustained and barrels may become degraded or fail after only one or two thousand rounds have been fired, and accuracy may decline quickly. Typically, a shooter in the field cannot remedy this (sometimes sudden) decline in accuracy, and changing barrels when in the field and away from an armorer's expert help is not an option.

Military and precision firearms may be subjected to substantial abuse, so very serious requirements and restrictions are encountered in the development of militarily acceptable rifle systems. Military rifles such as the M-110 (e.g., 100 as shown in FIGS. 1A, 1B and 1C) show rifle 100 having a barrel 102 affixed to a receiver 101 and the barrel is covered with a detachable picatinny rail equipped handguard attachment 103 (as described and illustrated in U.S. Pat. No. 5,826,363). The M-110 (or "SASS") rifle requires each new fixed barrel 102 to be fitted by an armorer or gunsmith and so is not replaceable by the shooter or user in the field.

When the armorer changes the barrel on the M-110 SASS rifle, replacement barrel must be fitted to the receiver by a trained armorer using special tools and the bolt carrier group and specifically the bolt head must be adjusted for proper headspace, in order to avoid a dangerous condition. Fitting a new barrel to other types of rifles (e.g., the bolt action M24 precision rifle also requires the services of a trained armorer using a different set of special tools and that rifle's bolt and chamber must be carefully adjusted for proper headspace in order to avoid danger.

Therefore, there is a need in the art for a precision rifle or assembly and method that allows a user or shooter to change barrels without requiring the assistance of an armorer or gunsmith, and preferably an assembly which adds minimal or no weight to a weapon system, is easy to set up correctly and accurately and which is durable and so does not require excessive care or special handling. There is also a need for a convenient, flexible, structurally rigid but ergonomically friendly and unobtrusive system and method allowing users to make changes in barrels and thus enable changes in ammunition caliber or type, when in the field with a weapon such as a rifle.

OBJECTS AND SUMMARY OF THE INVENTION

Accordingly, it is an object of the present invention to overcome the above mentioned difficulties by providing a convenient, flexible, structurally rigid but ergonomically friendly modular precision rifle assembly and a method for configuring rifle components which allows users to remove and change barrels and optionally bolt heads (i.e., for a replacement barrel for use with the same ammunition or a barrel configured for shooting a different ammunition caliber or type) when in the field and away from an armorer or gunsmith.

The modular precision rifle assembly of the present invention includes three field interchangeable and serviceable subassemblies or modules which are user installable and adjustable in the field, away from an armorer or gunsmith, and allow the user or shooter to change barrels and optionally bolt heads so that, for a given caliber (e.g., 7.62×51 NATO or 308 Win.) a worn barrel subassembly may be easily replaced with a new barrel subassembly or, for a shooter who desires to change calibers, a first barrel subassembly of a first caliber may be removed from the rifle assembly and a second barrel subassembly of a second caliber (e.g., 6XC) may be installed in its place. The three modular subassemblies are (a) the receiver subassembly, (b) the barrel subassembly and (c) the forend subassembly, which is removed from the receiver subassembly by the user in order to remove or install a barrel subassembly.

The receiver subassembly or module includes an aluminum receiver housing or member made in a unitary or a one-piece aluminum material construction, providing less weight overall versus steel action construction and eliminating any need of conventional stocks or any form of "bottom metal" (to support and align a detachable magazine), and thus avoids the adjustment issues inherent with common action screws. The receiver housing or member defines a cylindrical lumen aligned along a central axis where the central lumen or though hole and two radial "race-ways" run through the axial length of the receiver housing in a shape of proper fit to allow insertion and actuation of a bolt assembly. The proximal end of the receiver housing at a bottom rear section defines a large opening with internal grooves running axially or lengthwise to accept male splines present along the walls of a removable trigger housing which preferably includes a trigger mechanism configured to provide the advantages of Applicant's commonly owned T7T® trigger assembly (as illustrated and described in U.S. Pat. No. 9,267,750, the entire disclosure of which is incorporated by reference). The receiver subassembly or module's trigger housing is accepted into the receiver housing, rear to front, utilizing splines defined in axial or longitudinal grooves and is preferably fixed into place via a fastener at the rear or proximal bottom corner of the receiver housing. The forward surface of the trigger housing provides a flat plane to assist alignment and insertion of a detachable box magazine assembly.

The receiver housing has an ejection port opening defined through as left or right sidewall for loading and ejection of cartridges. Along the same side as the ejection port, towards the rear of the receiver housing, clearance cavities are provided to allow forward and aft actuation of the bolt handle, (attached to the bolt assembly), as well as rotation of the bolt handle into a closed position for firing. The receiver housing's central axially aligned open lumen projects forwardly or distally to define a distal opening and cylindrical cavity with an smooth interior surface which is configured to receive and concentrically align a cylindrical flanged barrel extension (included on the barrel subassembly, described further below). The receiver housing's distal cylindrical cavity defines a threaded interior surface terminating in the interior in an annular wall surface with a transverse or square face providing a bearing surface strong enough to accept the torque associated with attaching a barrel. The forward or distal portion of the receiver housing is generally of a tubular shape with multiple axially aligned cylindrical cavity sections to allow the insertion of the barrel assembly or module with a pre-attached barrel extension and the barrel assembly is fastened to the receiver housing via a threaded receiver barrel coupler/nut or barrel retaining nut. Along the forward most or distal end of the outside diameter of the receiver housing is a threaded section configured to accept a forend tube nut along with the rest of the forend subassembly (as described and illustrated further in commonly owned U.S. application Ser. No. 15/224,646, the entire disclosure of which is incorporated by reference).

The barrel subassembly includes a barrel having a central bore with a chamber defined in a proximal end and a muzzle crown defined in a distal end. The barrel subassembly includes, affixed to the barrel's proximal or chamber end, a barrel extension member made of heat treated precipitating-hardening stainless steel for proper strength to absorb the energy delivered to barrel extension member's locking lug bearing surfaces during firing. The forward or distal end of the barrel subassembly's barrel extension member consists of a flange with a male conical or convex face and a square shoulder just behind it to be accepted into a cavity and square shoulder of the receiver housing's lumen. The receiver subassembly or module also includes a receiver barrel coupler/nut or barrel retaining nut which has a cooperating female conical or concave surface at its rear to mate to the male conical surface of the barrel extension member, thereby assisting concentric fastening of the barrel extension and pre-attached barrel without the requirement of an intimate fit into the receiver housing's distal cavity. Radial orientation of the barrel extension member's locking lug bearing surfaces, feed ramp and gas vent are provided by an inwardly projecting alignment pin permanently installed into the Receiver's distal lumen, which forces radial alignment with and is accepted by a half-moon shaped slot defined in the top rear face of the barrel extension member. Therefore, upon assembly, the barrel extension member's locking lug bearing surfaces, feed ramp and gas vent are correctly aligned to the receiver housing's "race-ways", feed ramp and gas vent.

The barrel subassembly's barrel extension has an axially aligned central lumen which defines a conical bearing surface towards the rear or proximal end, and that conical bearing surface is configured to accept the conical surfaces of the bolt head's three transversely projecting locking lugs, thereby greatly assisting in concentric alignment of the bolt assembly when in battery relative to center-of-bore, and provides a well-supported perpendicular bolt face relative to the receiver's central axis, which is coaxial with the barrel assembly's center-of-bore. Additionally, within the barrel extension member's central lumen sidewall, three helical clearances are provided for (a) inserting and closing and (b) withdrawing and opening the bolt throughout the extraction cam cycle. The critical attributes of geometrically correct coaxially aligned attachment of the barrel assembly and bolt lock-up interface, proper extraction clearance, and strength of material are all provided in a compact and removable component, making the barrel subassembly's barrel extension relatively economical to produce and replicate, providing a particular advantage for "switch-barrel" precision rifle applications.

The receiver subassembly's barrel coupler/nut or retaining nut has an outer sidewall defining a threaded diameter along a proximal section of its outside diameter to be accepted into the threaded cavity interior wall defined in the distal portion of the receiver housing lumen at the front of the receiver subassembly or module. The forward or distal face of the barrel coupler/nut or retaining nut includes a circular array of blind holes arranged in a pattern to accept an "AR-15" type armorer wrench, providing a convenient mechanism to attach or detach the retaining nut within the receiver housing. Upon assembly, the forward or distal face of the barrel coupler/nut or retaining nut projects distally and sits just proud of the forward end of the receiver housing, and has a forwardly projecting, thin sleeve-like tubular extension configured to slide into and support axially aligned and abutting features defined in the forend subassembly's forend tube extension.

The forend subassembly's forend tube member has a rear orifice to accept the forend tube extension via an intimate mating of diameters (press fit) and is retained and fastened by four dowel cross-pins. The forend assembly is drawn proximally and held tight against the receiver housing by a forend tube nut which has an inwardly projecting flange or lip that engages a radially projecting flange on the tube extension upon assembly of (a) the forend tube, (b) the tube extension and (c) the forend tube nut all of which may rotate freely about the common center-line of the forend subassembly until final assembly and tightening. The forend tube nut has a knurled exterior surface to provide enhanced grip and presents a threaded orifice or lumen to attach the completed forend assembly to the receiver housing. The forend tube extension also has a proximal flange surface with a plurality (e.g., four) proximally projecting tabs to be accepted in multiple slots present at the forward face of the receiver, thereby allowing the forend assembly to be easily indexed to multiple angular locations along its center-line first at increments of five degrees, then twenty two and one half degrees thereafter.

The forend tube extension's central lumen defines a proximal counter bore section configured to accept the barrel coupler/nut's forwardly projecting thin sleeve-like tubular extension, so that upon complete assembly to the receiver housing, the forend tube nut fastens the rear face of the forend tube extension's flange to the forward face of the barrel coupler/nut, where the above described interaction provides support to the forend assembly while preventing the transfer of stress to the protruding tabs of the forend tube extension. Upon final assembly, loosening the forend tube nut just slightly allows the easy rotation and indexing of the forend assembly, while complete loosening of the forend tube nut allows complete removal of the forend assembly.

The modular precision rifle assembly of the present invention provides a new method for allowing a shooter or user to manipulate the three field interchangeable and serviceable subassemblies or modules which and install or adjustable those modules in the field, away from an armorer or gunsmith, allowing the user or shooter to change barrels and optionally bolt heads so that, for a given caliber (e.g., 7.62×51 NATO or 308 Win.) a worn barrel subassembly may be easily replaced with a new barrel subassembly or, for a shooter who desires to change calibers, a first barrel subassembly of a first caliber may be removed from the rifle assembly and a second barrel subassembly of a second caliber (e.g., 6XC) may be installed in its place. The three modular subassemblies are the receiver subassembly, the barrel subassembly and the forend subassembly, which is removed from the receiver subassembly by the user in order to remove or install a barrel subassembly.

The modular precision rifle of the present invention is preferably used in connection with a tool kit that includes a portable bench vice configured to clamp onto a barrel's external profile, a strap wrench, an AR-15 style multi-pin wrench and an elongated action wrench which is insertable into the receiver housing's lumen from the rear, in place of the bolt assembly (terminating distally or forwardly in a simulated fixed bolt-head shaped driver).

The method for changing a barrel on an assembled precision rifle includes the following method steps: (a) removing the bolt assembly from the receiver subassembly or module, (b) unfastening and loosening the forend tube nut (optionally, using a strap wrench) and removing the forend subassembly or module from the receiver subassembly by sliding it forwardly or distally over the barrel and beyond the barrel's muzzle; (c) unfastening and loosening and then removing the barrel coupler/nut or retaining nut from the receiver housing's distal lumen (using the AR-15 style multi-pin wrench) and then sliding it forwardly or distally over the barrel and beyond the barrel's muzzle; (d) slidably pulling the barrel subassembly distally or forwardly to withdraw the barrel and the barrel subassembly's barrel extension from the receiver housing's distal lumen opening. At this point in the method, the three major modules or subassemblies are apart and may be inspected.

When installing or re-installing a barrel subassembly into the receiver subassembly or module, the barrel coupler/nut or retaining nut (if present) is removed from the receiver housing's distal lumen and is placed over the barrel subassembly's distal end (i.e., the muzzle) and slidably advanced to the rear, to abut the barrel subassembly's barrel extension's flange. Next, the barrel subassembly, carrying the barrel coupler/nut or retaining nut is held in a fixed orientation (e.g. clamped in the bench vice in a substantially horizontal orientation) with the barrel extension's half-moon alignment slot in a generally vertical orientation so that the receiver subassembly or module can be slidably advanced onto the barrel subassembly's barrel extension and rotated radially about the central axis so that the receiver housing's alignment pin is received in and radially aligned by the barrel extension member's half-moon slot. Next, the user inserts and threadably engages and fastens the barrel coupler/nut or retaining nut with the threads in the receiver housing's lumen to draw the barrel subassembly into axial alignment with and proximally against the receiver subassembly or module. In this step, the barrel assembly's bore and receiver's central lumen are automatically coaxially aligned. Next, the user inserts the action wrench into the receiver housing's proximal or rear-facing lumen opening and slides the action wrench forwardly or distally so that the action wrench's simulated fixed bolt-head shaped driver is received by and engages the bolt-lug receiving surfaces within the barrel subassembly's barrel extension. In the next step, the user simultaneously applies counter-rotating forces to the action wrench and the barrel coupler/nut or retaining nut (e.g., with the AR-15 style multi-pin wrench) to apply a selected amount of torque (e.g., 50 to 100 ft/lbs of torque) to the barrel coupler/nut or retaining nut and fasten it to the receiver housing's distal end, thereby forcefully and automatically axially aligning and supporting the barrel subassembly on the receiver subassembly or module. Next, the action wrench is withdrawn rearwardly or proximally from the receiver housing and removed from the receiver housing, and the bolt assembly (with a bolt head previously headspaced to the newly installed barrel assembly) is installed in the receiver housing. Next, the receiver subassembly carrying the barrel subassembly or module is removed from the bench vice and the forend subassembly is re-installed by sliding it over the distal (i.e., muzzle) end of the barrel and slidably advanced rearwardly or proximally so that the forend subassembly's forend tube nut can be threadably fastened upon the external threads carried on the distal end of the receiver housing.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figures 1A, 1B, 1C:
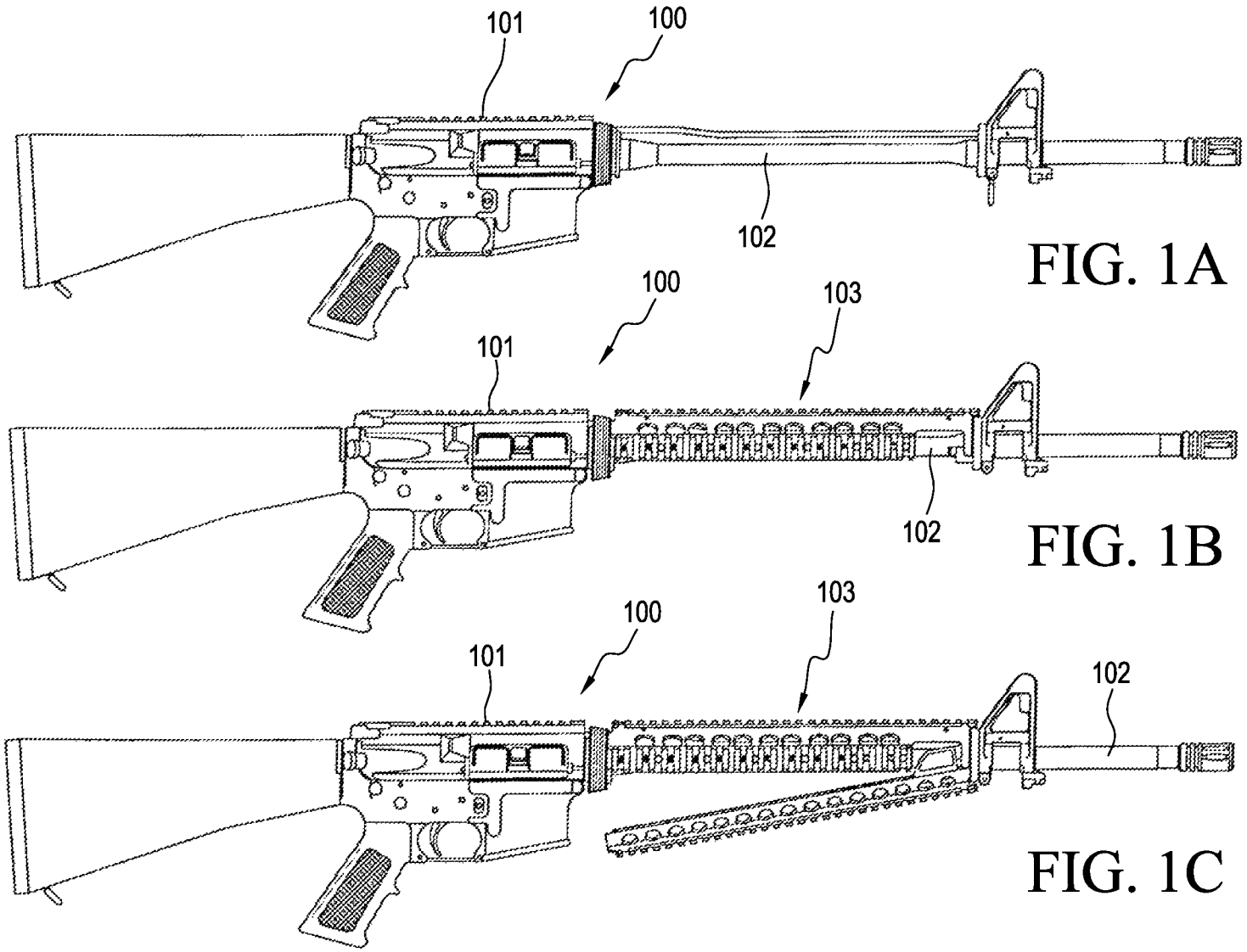
FIGS. 1A-1C illustrate a military pattern rifle (e.g. an M110 SASS) with a fixed barrel and standard quad-rail style forearm or handguard, as seen in the prior art.
Figure 2:
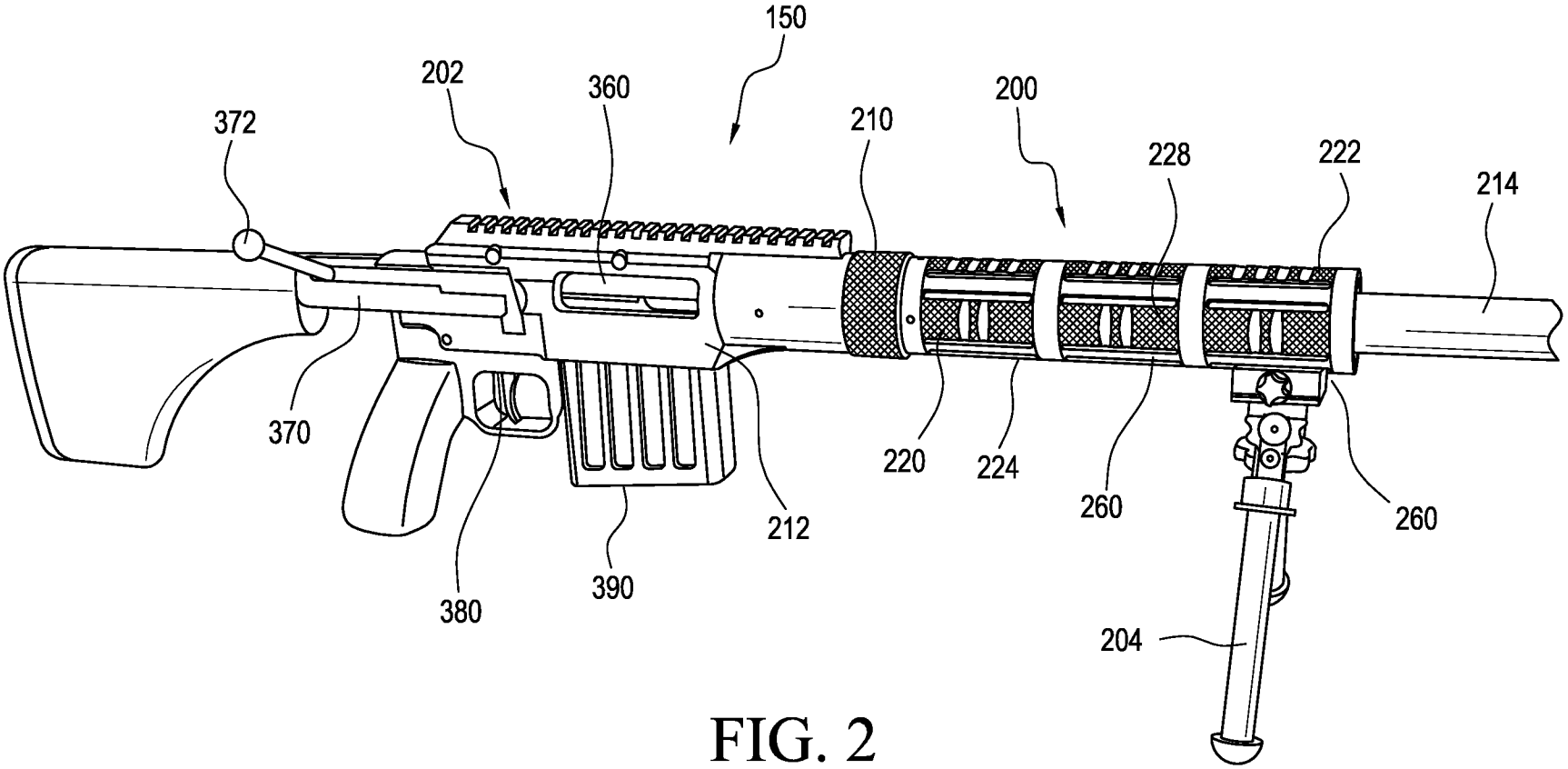
FIG. 2 is a perspective view in elevation of a modular precision rifle assembly illustrating a receiver subassembly assembled with a barrel subassembly and a forend subassembly, in accordance with the present invention.
Figure 3:
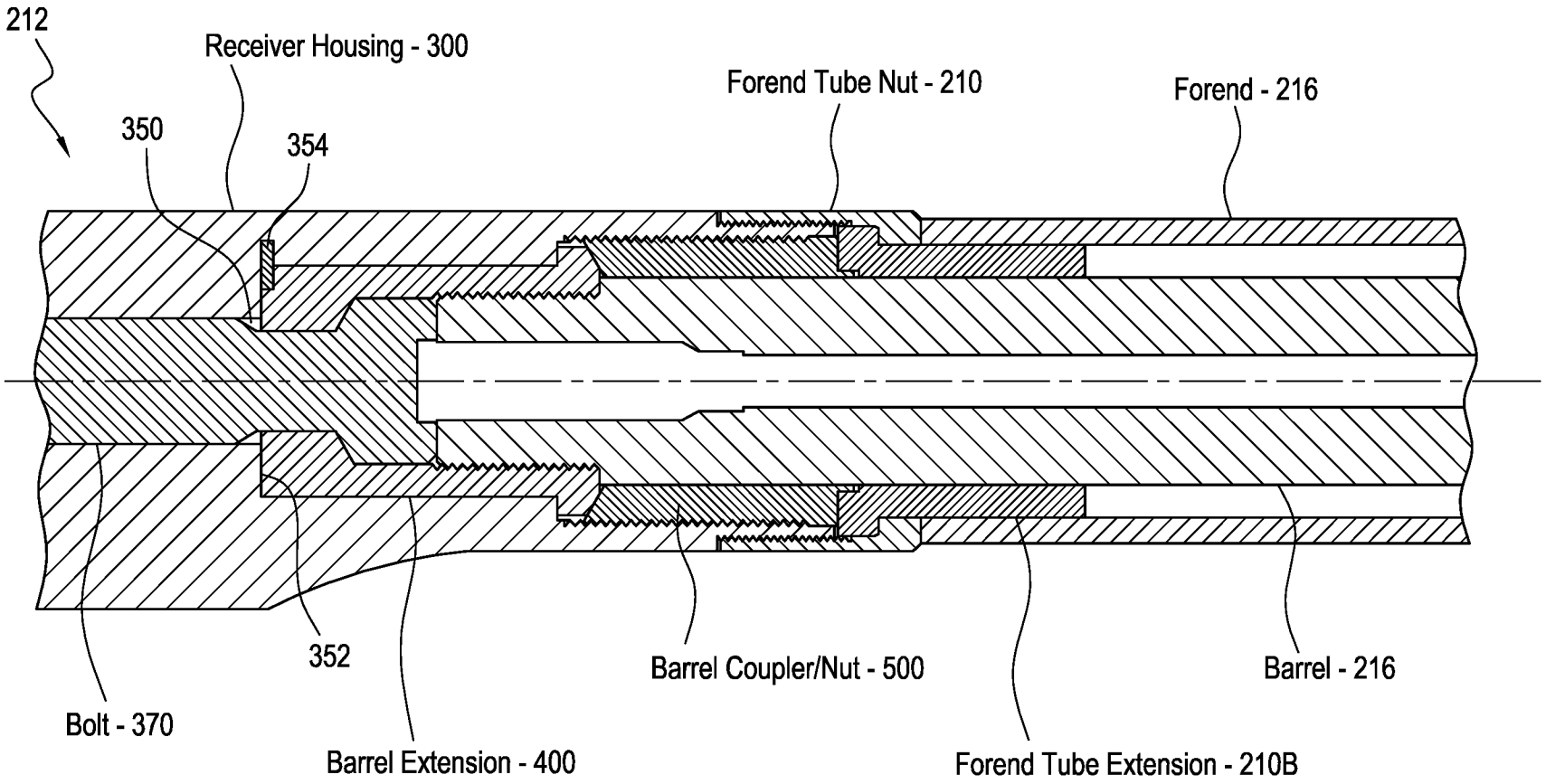
FIG. 3 is a cross sectional view, in elevation of the modular precision rifle assembly of FIG. 2, illustrating how the receiver subassembly is assembled with the barrel subassembly and the forend subassembly, in accordance with the present invention.
Figure 4A:
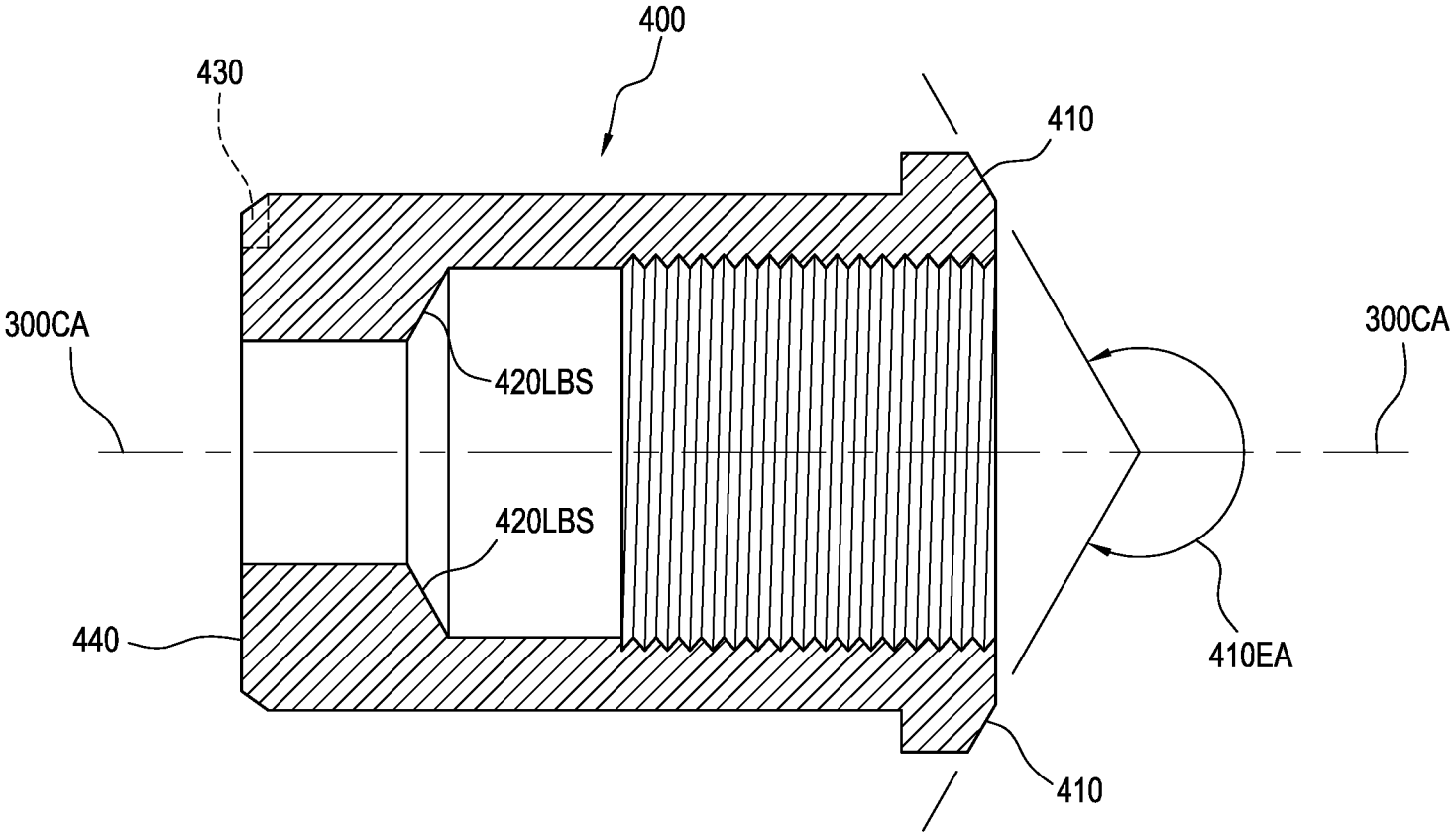
FIGS. 4A-4D are four views which illustrate the barrel subassembly's barrel extension member of FIGS. 2 and 3, in accordance with the present invention.
Figure 4D:
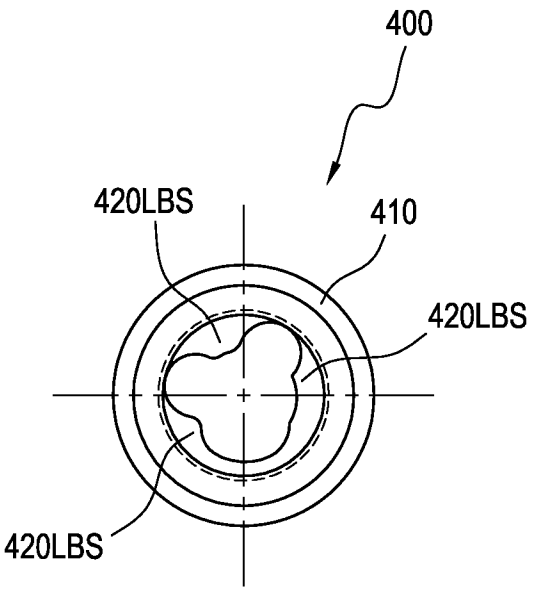
Figure 4C:
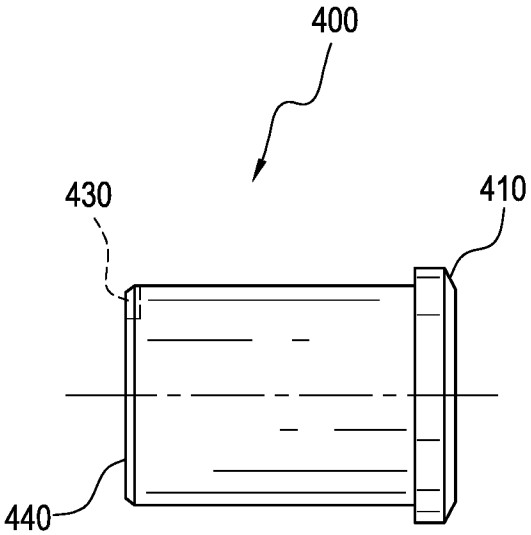
Figure 4B:
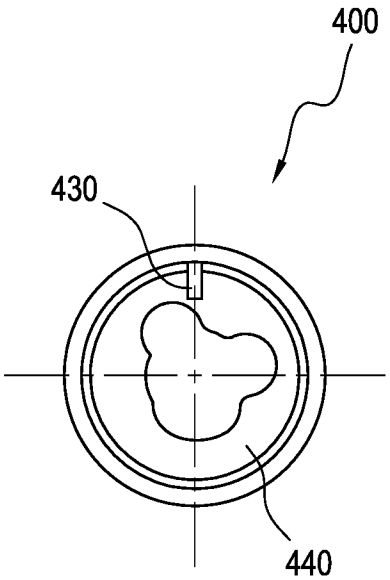

Turning initially to FIGS. 2 and 3, a modular precision rifle assembly 150 and method for configuring rifle components and allowing users to change barrels (i.e., for a replacement barrel for use with the same ammunition or a barrel configured for shooting a different ammunition caliber or type) is illustrated. Modular rifle assembly 150, when in use, provides a structurally rigid but ergonomically friendly and unobtrusive barrel mounting interface and forend subassembly 200 and a method for allowing users to removably attach the forend subassembly to a rifle's receiver subassembly 212 when changing a barrel and optionally a bolt head configured to be automatically headspaced with the replacement or new barrel 214.

Modular precision rifle assembly 150 of the present invention includes three field interchangeable and serviceable subassemblies or modules which are user installable and adjustable in the field, away from an armorer or gunsmith, and allow the user or shooter to change barrels and optionally bolt heads so that, for a given caliber (e.g., 7.62×51 NATO or 308 Win.) a worn barrel subassembly may be easily replaced with a new barrel subassembly or, for a shooter who desires to change calibers, a first barrel subassembly of a first caliber may be removed from the rifle assembly and a second barrel subassembly of a second caliber (e.g., 6XC) may be installed in its place. The three modular subassemblies are (a) the receiver subassembly 212, (b) the barrel subassembly 214 and (c) the forend subassembly 200, which is removed from the receiver subassembly by the user in order to remove or install a barrel subassembly.

Referring now to FIGS. 3-5D, receiver subassembly or module 212 includes an aluminum receiver housing or member 300 made in a unitary or a one-piece aluminum material construction, providing less weight overall versus steel action construction and eliminating any need of conventional stocks or any form of "bottom metal" (to support and align a detachable magazine), and thus avoids the adjustment issues inherent with common action screws. Receiver housing or member 300 defines a central internal lumen 350 aligned along a central axis 300CA where the central lumen or though hole and two radial "race-ways" run through the axial length of the receiver housing in a shape of proper fit to allow insertion and actuation of a bolt assembly 370. The proximal end of the receiver housing at a bottom rear section defines a large opening with internal grooves running axially or lengthwise to accept male splines present along the walls of a removable trigger housing 380 which preferably includes a trigger mechanism configured to provide the advantages of Applicant's commonly owned T7T® trigger assembly (as illustrated and described in U.S. Pat. No. 9,267,750, the entire disclosure of which is incorporated by reference). The receiver subassembly or module's trigger housing 380 is accepted into the receiver housing 300, rear to front, utilizing splines defined in axial or longitudinal grooves and is preferably fixed into place via a fastener at the rear or proximal bottom corner of the receiver housing 300. The forward surface of the trigger housing provides a flat plane to assist alignment and insertion of a detachable box magazine assembly 390.

Figure 6:
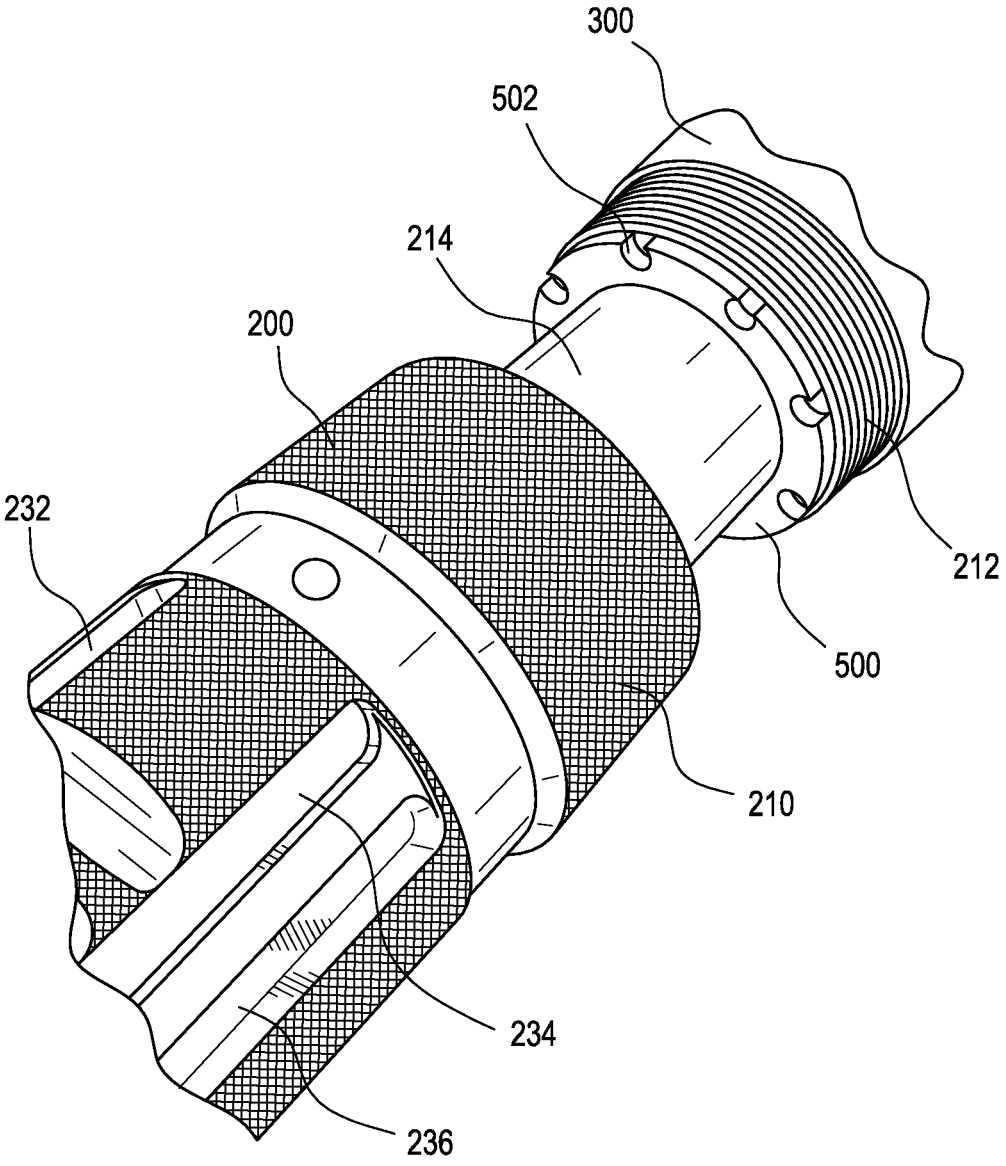
FIG. 6 is a perspective view of the distal end of the receiver housing illustrating the insertion of the barrel subassembly supported by the barrel retaining nut of FIGS. 3 and 5A-5D, with the forearm subassembly loosened and drawn back, in accordance with the present invention.
Figure 7:
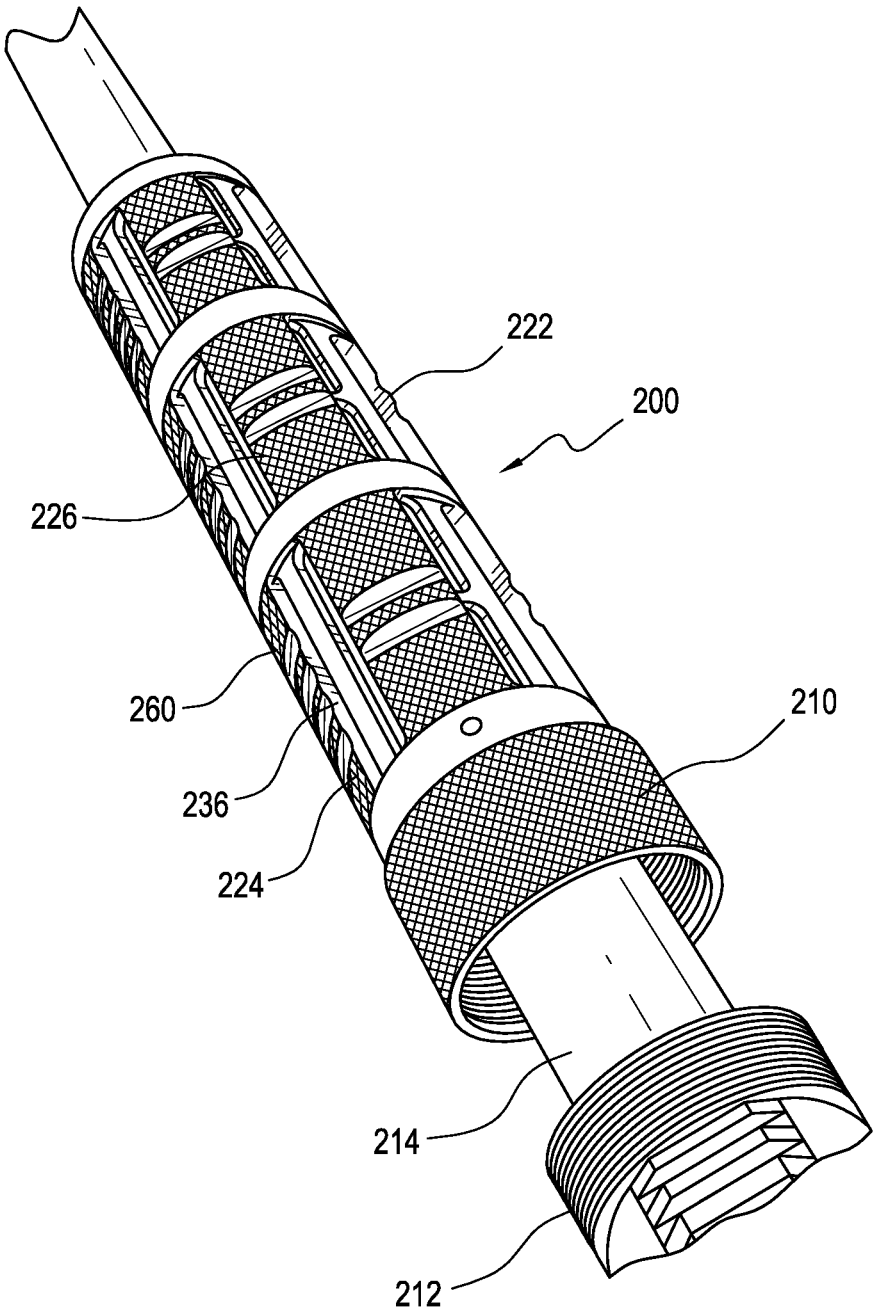
FIG. 7 is another perspective view the receiver housing illustrating the insertion of the barrel subassembly of FIGS. 2 and 3, with the forearm subassembly loosened and drawn back, in accordance with the present invention.
Figure 8:
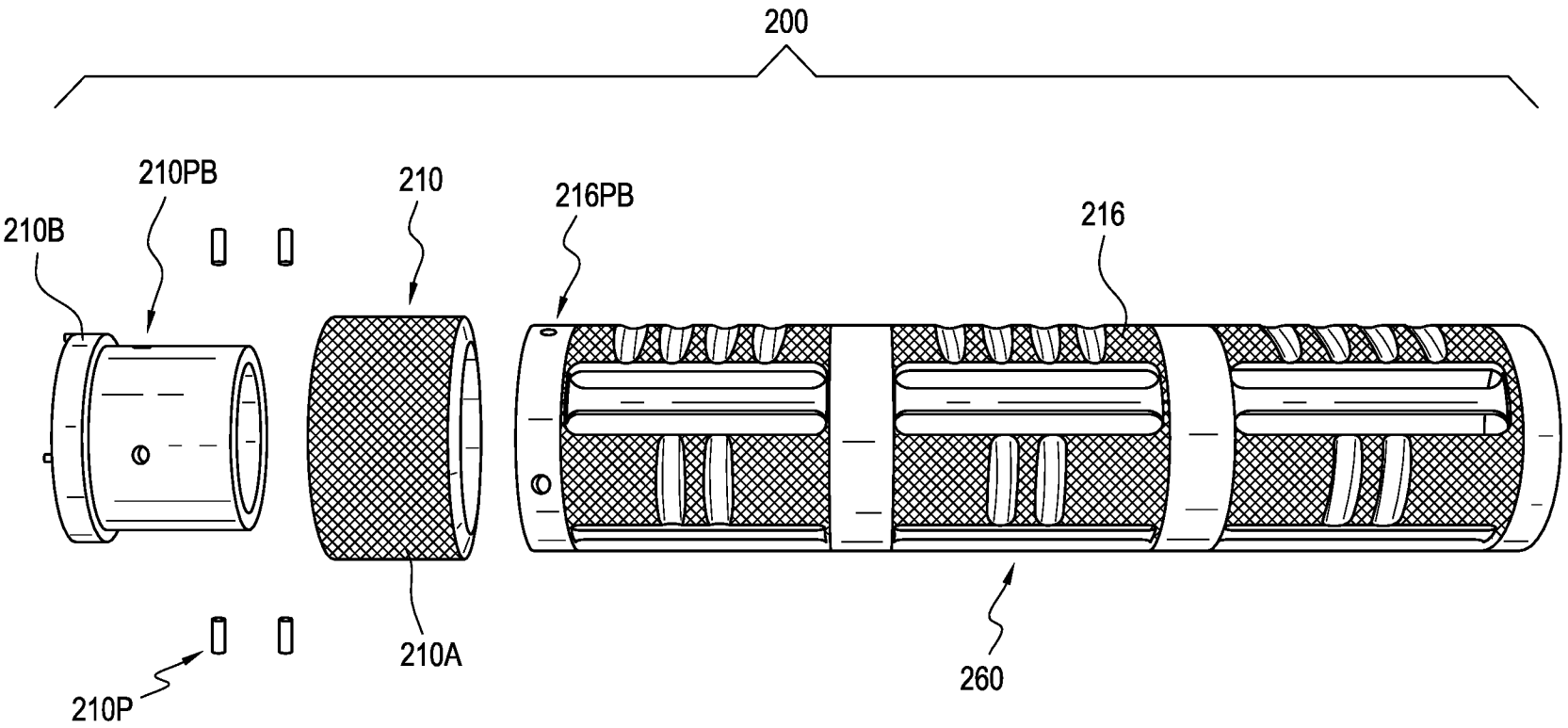
FIG. 8 is an exploded side view in elevation of the forearm subassembly of FIGS. 2, 6 and 7, in accordance with the present invention.
Figure 9:
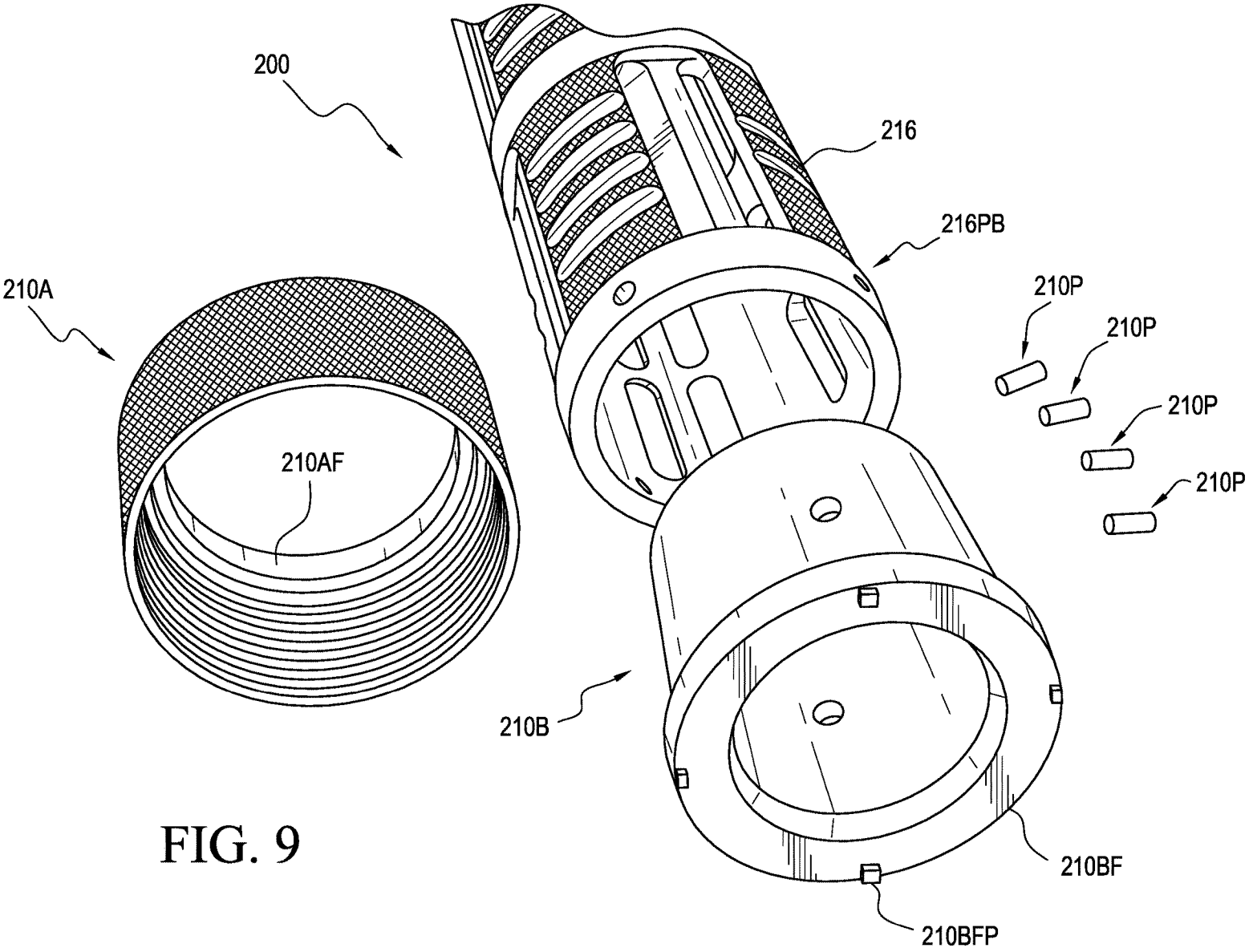
FIG. 9 is an exploded perspective view of the forearm subassembly of FIGS. 2, 6, 7 and 8, in accordance with the present invention.

Receiver housing 300 has an ejection port opening 360 defined through as left or right sidewall for loading and ejection of cartridges which provides access to the receiver housing's internal cavity or lumen 350. Along the same side as the ejection port, towards the rear of the receiver housing, clearance cavities are provided to allow forward and aft actuation of the bolt handle 372, (attached to 370 bolt assembly), as well as rotation of bolt handle 372 into a closed position for firing. The receiver housing's central axially aligned open lumen 350 projects forwardly or distally to define a distal opening and cylindrical cavity with an smooth interior surface (see, e.g., FIG. 3) which is configured to receive and concentrically align cylindrical flanged barrel extension 400 (included on the barrel subassembly 214, described further below). The receiver housing's distal cylindrical cavity also defines a threaded interior surface terminating in the interior in an annular wall surface with a transverse or square face providing a bearing surface strong enough to accept the torque associated with attaching a barrel. The forward or distal portion of the receiver housing 300 is generally of a tubular shape with multiple axially aligned cylindrical cavity sections (see, e.g., FIG. 3) to allow the insertion of barrel subassembly 214 which includes a barrel 216 which carries pre-attached barrel extension member 400 and barrel subassembly 214 is fastened to receiver housing 300 via a threaded receiver barrel coupler/nut or barrel retaining nut 500 (as best seen in FIGS. 3 and 6).

Along the forward most or distal end of the outside diameter of the receiver housing 300 is a threaded section configured to accept a forend tube nut 210 along with the rest of the forend subassembly 200 (as described and illustrated further in commonly owned U.S. application Ser. No. 15/224,646, the entire disclosure of which is incorporated by reference).

Barrel subassembly 214 includes a barrel 216 having a central bore with a chamber defined in a proximal end and a muzzle crown defined in a distal end. The barrel subassembly 214 includes, affixed to the barrel's proximal or chamber end, barrel extension member 400 which is machined from heat treated precipitating-hardening stainless steel for proper strength to absorb the energy delivered to barrel extension member's locking lug bearing surfaces during firing. Referring now to FIGS. 4A-4D, the forward or distal end of the barrel subassembly's barrel extension member 400 consists of a flange with a male conical or convex face 410 and a square shoulder just behind it to be slidably inserted into and snugly fitted within an unthreaded, smooth receiving cavity which terminates proximally in the torque-bearing square shoulder 352 defined within the receiver housing's lumen 350 (as best seen in FIG. 3). The receiver subassembly or module 212 also includes a receiver barrel coupler/nut or barrel retaining nut 500 (see FIGS. 5A-5D) which has a cooperating female conical or concave surface 520 at its rear to mate to the male conical surface 410 of the barrel extension member, once assembled, thereby assisting concentric fastening of the barrel extension 400 and pre-attached barrel without the requirement of an intimate fit into the receiver housing's distal cavity. Radial orientation of the barrel extension member's internal locking lug bearing surfaces 420 LBS, feed ramp and gas vent are provided by an inwardly projecting alignment pin 354 permanently installed into the Receiver's distal lumen, which forces radial alignment with and is accepted by a half-moon shaped slot 430 defined in the top rear face of barrel extension member 400. Therefore, upon assembly, the barrel extension member's locking lug bearing surfaces 420 LBS, feed ramp and gas vent are correctly aligned to the receiver housing's "race-ways", feed ramp and gas vent.

The barrel subassembly's barrel extension 400 has an axially aligned central lumen which defines a conical bearing surface defines the locking lug bearing surfaces 420 LBS towards the rear or proximal end, and that conical bearing surface is configured to accept the conical surfaces of the bolt head's three transversely projecting locking lugs, thereby greatly assisting in concentric alignment of the bolt assembly 370 when in battery relative to center-of-bore, and provides a well-supported perpendicular bolt face relative to the receiver's central axis 300CA, which is coaxial with the barrel assembly's center-of-bore, once assembled. Additionally, within the barrel extension member's central lumen sidewall, three helical clearances are provided for (a) inserting and closing and (b) withdrawing and opening the bolt 370 throughout the extraction cam cycle. The critical attributes of geometrically correct coaxially aligned attachment of the barrel subassembly 214 and bolt lock-up interface, proper extraction clearance, and strength of material are all provided in a compact and removable barrel extension 400 which is relatively economical to produce and replicate, providing a particular advantage for "switch-barrel" precision rifle applications.

Figure 5A:
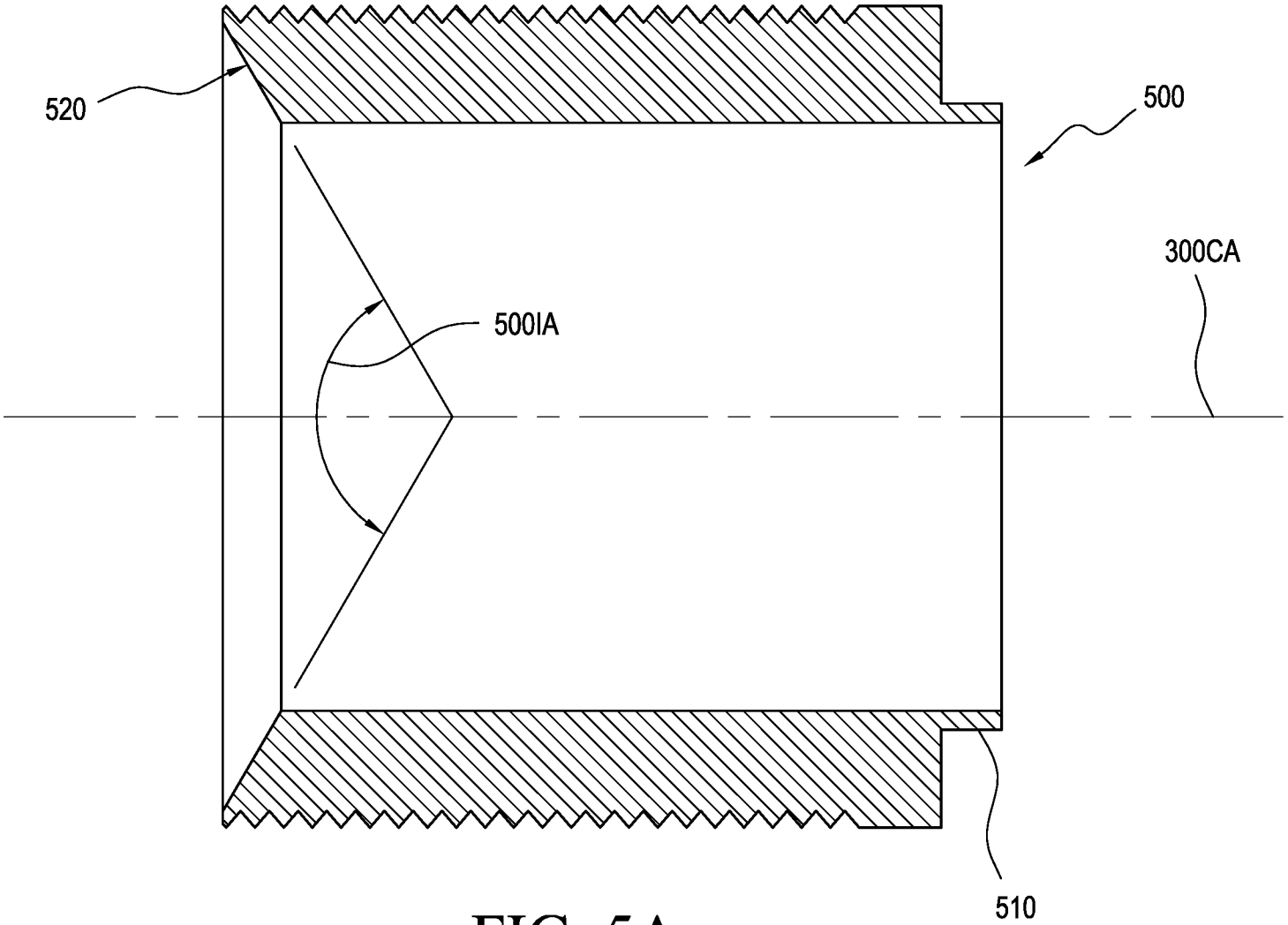
FIGS. 5A-5D are four views which illustrate the receiver subassembly's receiver barrel coupler/nut or barrel retaining nut of FIGS. 2 and 3, in accordance with the present invention.
Figure 5D:
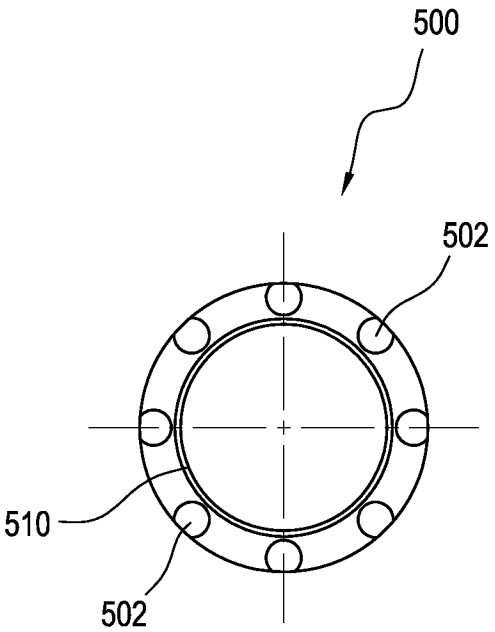
Figure 5C:
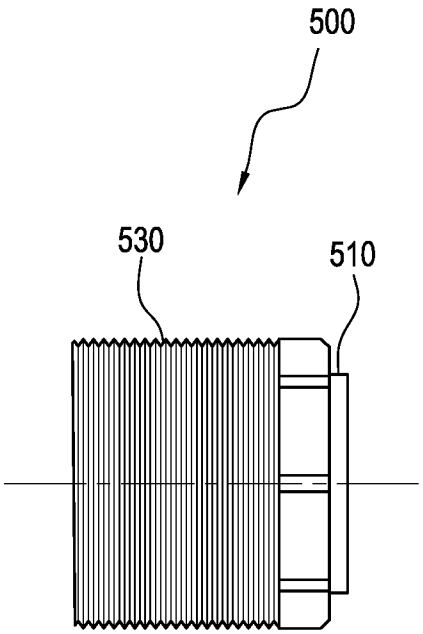
Figure 5B:
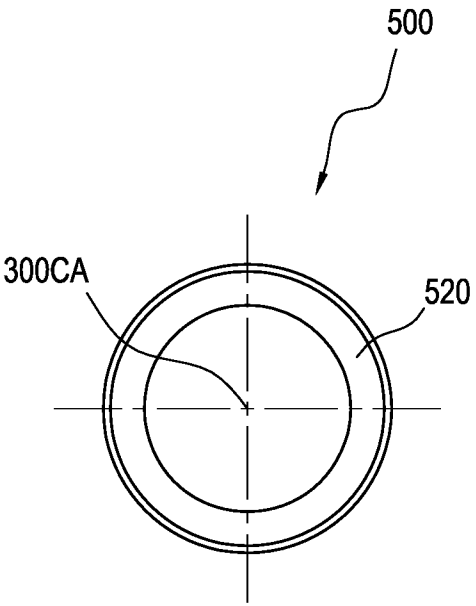

The receiver subassembly's barrel coupler/nut or retaining nut 500 (as best seen in FIGS. 3, 5A-5D and 6) has an outer sidewall carrying threads 530 defining a threaded diameter along at least a proximal section of its outside diameter to be accepted into the threaded cavity interior wall defined in the distal portion of the receiver housing lumen 350 at the front of the receiver subassembly or module 212. The forward or distal face of the barrel coupler/nut or retaining nut 500 includes a circular array of blind bores or holes 502 arranged in a pattern to accept arrayed pins of an "AR-15" type armorer wrench (see, e.g., bores or holes 502 are best seen in FIGS. 5D and 6), providing a convenient mechanism to attach or detach retaining nut 500 within the receiver housing 300. Upon assembly, the forward or distal face of the barrel coupler/nut or retaining nut 500 projects distally and sits just proud of the forward end of the receiver housing 300, and has a forwardly projecting, thin sleeve-like tubular extension 510 configured to slide into and support axially aligned and abutting features defined in the forend subassembly's forend tube extension 210B.

Referring now to FIGS. 3 and 6-10, forend subassembly 200 includes forend tube member 260 with a rear orifice to accept the forend tube extension 210B via an intimate mating of diameters (press fit) and is retained and fastened by four dowel cross-pins 210P. Forend assembly 200 is drawn proximally and held tight against the receiver housing 300 by forend tube nut 210A which has an inwardly projecting flange or lip 210AF that engages a radially projecting flange 210BF on tube extension member 210B upon assembly of (a) the forend tube, (b) the tube extension and (c) the forend tube nut all of which may rotate freely about the common center-line of the forend subassembly 200 until final assembly and tightening. The forend tube nut 210A has a knurled exterior surface to provide enhanced grip and presents a threaded orifice or lumen to attach the completed forend assembly to the receiver housing 300. The forend tube extension also has a proximal flange surface with a plurality (e.g., four) proximally projecting tabs or pins 210BFP to be accepted in multiple slots present at the forward face of the receiver housing 300, thereby allowing the forend assembly 200 to be easily indexed to multiple angular locations along its center-line first at increments of five degrees, then twenty two and one half degrees thereafter.

The central lumen of forend tube extension 210B defines a proximal counter bore section configured to accept the barrel coupler/nut's forwardly projecting thin sleeve-like tubular extension 510, so that upon complete assembly to the receiver housing 300, the forend tube nut 210 centers, supports and releasably fastens the rear face of the forend tube extension's flange to the forward face of the barrel coupler/nut 500, where the above described interaction provides both axial and radial support to the forend assembly 200 while preventing the transfer of stress to the protruding tabs or pins 210BFP of the forend tube extension 210B. Upon assembly, loosening the forend tube nut 210 just slightly allows the user to easily rotate and index the forend assembly 200, while complete loosening of the forend tube nut allows complete removal of the forend assembly from the receiver subassembly 212.

The modular precision rifle assembly 150 of the present invention as illustrated in FIGS. 2-10 provides a new method for allowing a shooter or user to manipulate the three field interchangeable and serviceable subassemblies or modules (namely, receiver subassembly 212, forend subassembly 200, and barrel subassembly 214) and install or adjust those modules in the field, away from an armorer or gunsmith, allowing the user or shooter to change barrels and optionally bolt heads so that, for a given caliber (e.g., 7.62×51 NATO or 308 Win.) a worn barrel subassembly may be easily replaced with a new barrel subassembly or, for a shooter who desires to change calibers, a first barrel subassembly of a first caliber may be removed from the rifle assembly and a second barrel subassembly of a second caliber (e.g., 6XC) may be installed in its place. The forend subassembly 200 is removed from receiver subassembly 212 by the user in order to remove or install a new or replacement barrel subassembly 214.

Figure 13:
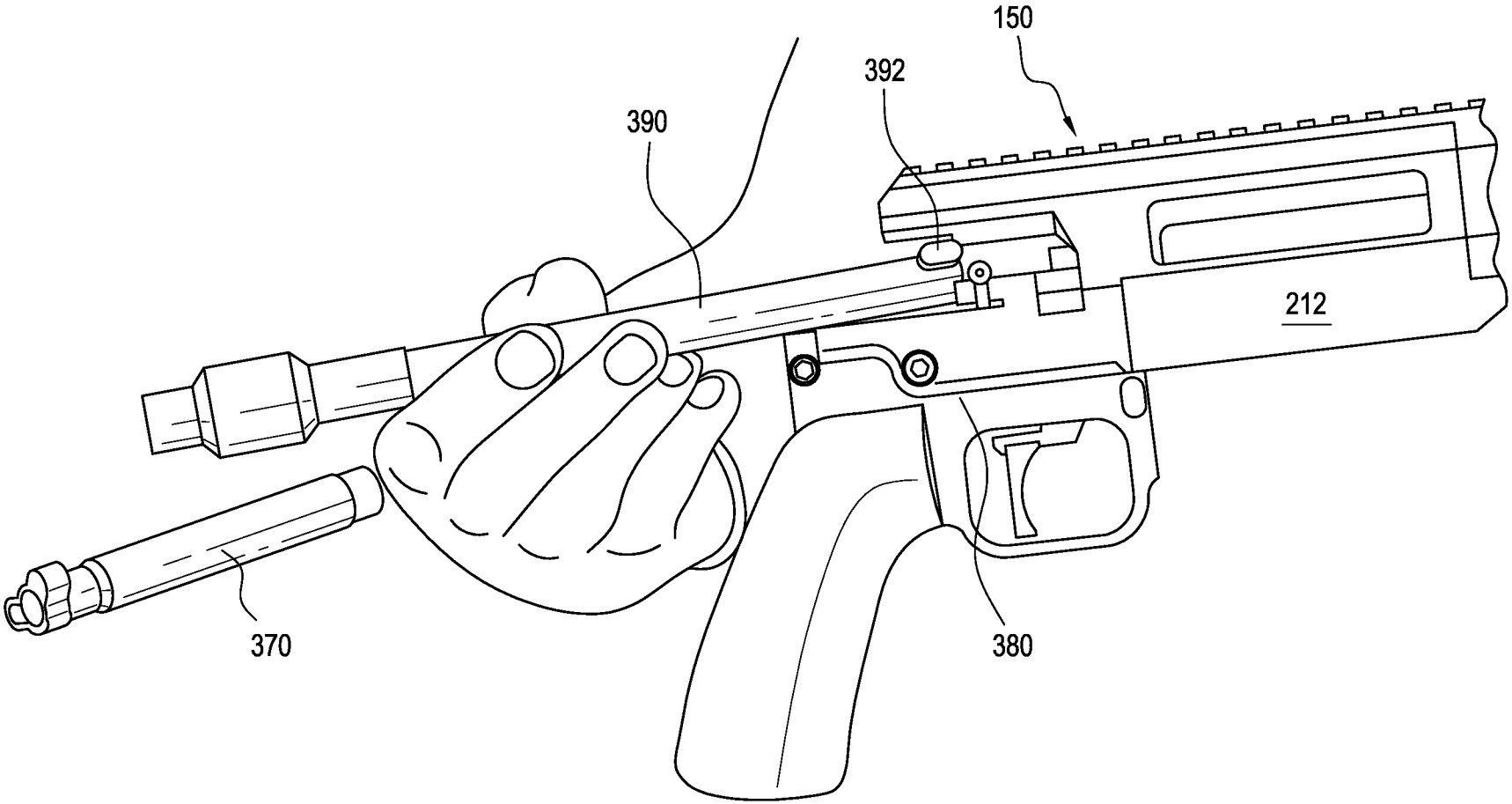
FIGS. 13 and 14 illustrate tools used in assembling and reconfiguring the modular precision rifle or FIGS. 2-12, in accordance with the present invention.
Figure 14:
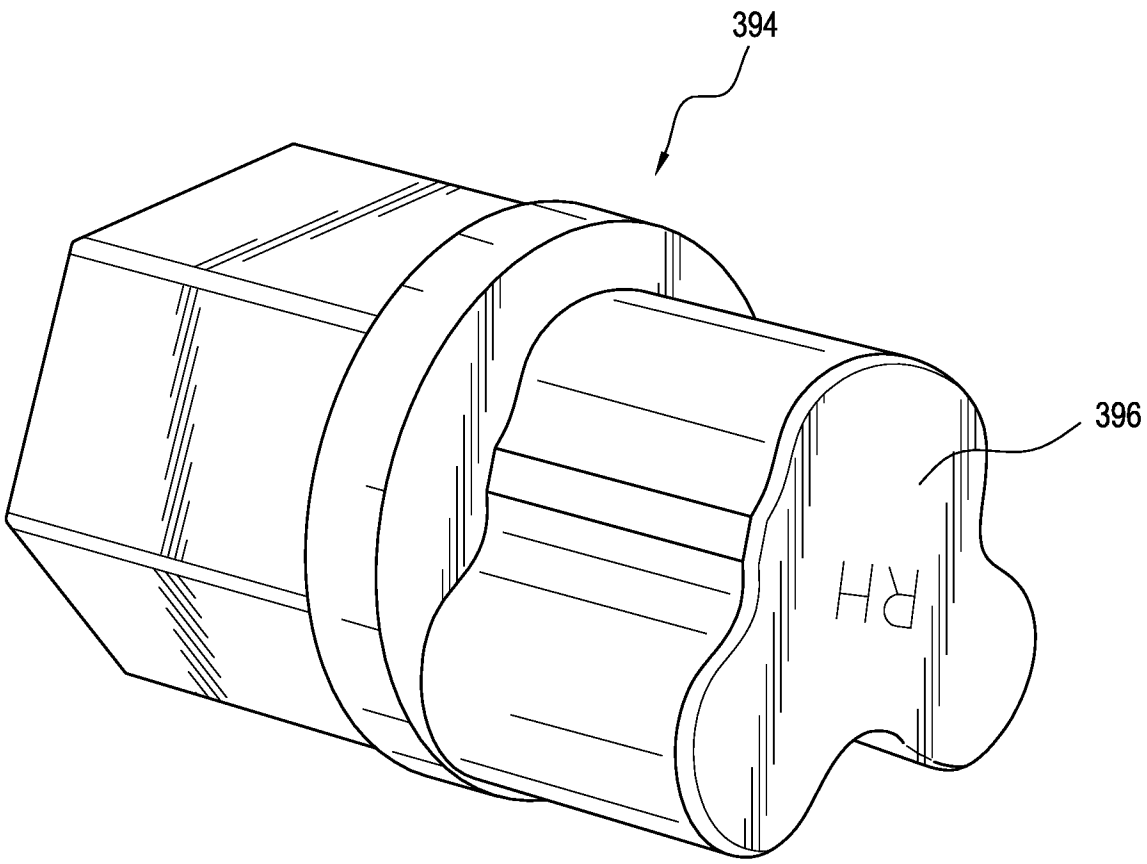

Turning now to FIGS. 13 and 14, modular precision rifle 150 is preferably used in connection with a tool kit that includes a portable bench vice (not shown) configured to clamp onto a barrel's external profile, a strap wrench (not shown) for gripping and turning forend tube nut 210, an AR-15 style multi-pin wrench (not shown) for engaging the pin receiving bores 502 in receiver barrel coupler/nut or barrel retaining nut 500 and an elongated action wrench 390 which is insertable into the receiver housing's lumen from the rear (as seen in FIG. 13) in place of the bolt assembly 370. Elongated action wrench 390 has a hex head on its proximal end and terminates distally or forwardly in a simulated fixed bolt-head shaped driver or end effector 392. Optionally, a user may choose to make her or his own barrel subassembly 214 by threadably attaching a barrel extension member 400 to the proximal threaded tenon or end of a user-supplied barrel 216 using a barrel extension member tool 394 (which also has a simulated fixed bolt-head shaped driver or end effector 396).

The method for changing a barrel on an assembled modular precision rifle assembly 150 includes the following method steps: (a) removing the bolt assembly 370 from the receiver subassembly or module 212, (b) unfastening and loosening the forend tube nut 210 (optionally, using a strap wrench) and removing the forend subassembly or module 200 from the receiver subassembly 212 by sliding it forwardly or distally over the barrel and beyond the barrel's muzzle; (c) unfastening and loosening and then removing the barrel coupler/nut or retaining nut 500 from the receiver housing's distal lumen (using the AR-15 style multi-pin wrench in retaining nut pin receiving bores 502) and then sliding barrel retaining nut 500 forwardly or distally over the barrel and beyond the barrel's muzzle; (d) slidably pulling barrel subassembly 214 distally or forwardly to withdraw the barrel 216 and the barrel subassembly's barrel extension 400 from the receiver housing's distal lumen opening. At this point in the method, the three major modules or subassemblies are apart and may be inspected.

When installing or re-installing a barrel subassembly 214 into the receiver subassembly or module 212, the barrel coupler/nut or retaining nut 500 (if present) is removed from the receiver housing's distal lumen and is placed over the barrel subassembly's distal end (i.e., the muzzle) and slidably advanced to the rear, to abut the barrel subassembly's barrel extension's flange. Next, barrel subassembly 214, carrying barrel coupler/nut or retaining nut 500 is held in a fixed orientation (e.g. clamped in the bench vice in a substantially horizontal orientation) with the barrel extension's half-moon alignment slot 430 in a generally vertical orientation so that the receiver subassembly or module 212 can be slidably advanced onto the barrel subassembly's barrel extension 400 and rotated radially about the central axis 300CA so that the receiver housing's alignment pin 354 is received in and radially aligned by the barrel extension member's half-moon slot 430 (see FIGS. 3 and 4B). Next, the user inserts and threadably engages and fastens the barrel coupler/nut or retaining nut 500 with the threads in the receiver housing's lumen to draw barrel subassembly 214 into axial alignment with and proximally against the receiver subassembly or module 212 (see FIG. 6). In this step, the barrel assembly's bore and receiver's central lumen are automatically coaxially aligned with a common central axis 300CA (see FIG. 3). Next, the user inserts the action wrench 390 into the receiver housing's proximal or rear-facing lumen opening (as best seen in FIG. 13) and slides action wrench 390 forwardly or distally so that the action wrench's simulated fixed bolt-head shaped driver or end effector 392 is received by and engages the bolt-lug receiving surfaces within the barrel subassembly's barrel extension 420. In the next step, the user simultaneously applies counter-rotating forces to the action wrench 380 and the barrel coupler/nut or retaining nut 500 (e.g., with the AR-15 style multi-pin wrench) to apply a selected amount of torque (e.g., 50 to 100 ft/lbs of torque) to the barrel coupler/nut or retaining nut 500 and tighten it to the receiver housing's cavity surface 352, thereby forcefully and automatically axially aligning and supporting the barrel subassembly on the receiver subassembly or module. Next, the action wrench is withdrawn rearwardly or proximally from the receiver housing and removed from the receiver housing, and the bolt assembly (with a bolt head previously headspaced to the newly installed barrel assembly) is installed in the receiver housing. Next, the receiver subassembly 212 carrying the barrel subassembly or module 214 is removed from the bench vice and the forend subassembly 200 is re-installed by sliding it over the distal (i.e., muzzle) end of the barrel and slidably advanced rearwardly or proximally so that the forend subassembly's forend tube nut can be threadably fastened upon the external threads carried on the distal end of the receiver housing.

Referring again specifically to FIGS. 3-4D, barrel extension member 400 has a cylindrical sidewall having an open proximal lumen configured to receive the bolt head 330, when installed and in use. Barrel extension member 400 has an annular proximal end wall which is tightened proximally into a corresponding coaxial bore defined in receiver 212. Barrel extension member 400 has a flanged distal end wall surrounded by an angled shoulder surface or self-centering force generating outwardly angled surface 410 with an exterior angle 410EA of, preferably, about 250 degrees. Optionally, cooperating centering force generating surface 410 may be defined as two or more annular angled planar sections or be defined as a convex section (e.g., of a spherical section).

Referring next to FIGS. 3 and 5A-5D, receiver barrel coupler/nut or barrel retaining nut 500 has a cylindrical sidewall having an open proximal lumen and is configured to be forced into coaxial concentricity with and bear against barrel extension member 400, when installed and in use. Receiver barrel coupler/nut or barrel retaining nut 500 has a frustoconical and inwardly angled self-centering force generating surface 520 with an interior angle 520IA of, preferably, about 110 degrees, which was determined, in applicant's development work, to provide reliable and repeatable concentric self-centering engagement with the cooperating frustoconical surface 410 of coaxially aligned barrel extension member 400. Optionally, cooperating centering force generating surface 520 may also be defined, respectively, as two or more annular angled planar sections or be defined as a concave section (e.g., of a spherical section), configured in a manner to cooperate with surface 410 on the barrel extension member 400.

When assembled by the user or shooter in the field in accordance with the method of the present invention, a barrel subassembly 214 comprising barrel 216 carrying an affixed barrel extension 400 is first inserted into the open distal lumen defined in receiver 212 and is drawn proximally and limited in proximal engagement by forcing the self-centering exterior frustoconical surface 410 of barrel extension 400 against the corresponding interior frustoconical abutment surface 520 defined on in the proximal end of barrel coupler-nut member 500 when barrel extension 400 is inserted within and supported by receiver 212.

Referring next to FIGS. 2, 3, 11 and 12, bolt assembly 370 consists of a Bolt Body, with a continuous diameter from the front discontinued towards the rear with a smaller diameter and parallel flats, where the said smaller diameter and parallel flats are configured to accept a Bolt Handle 372. The bolt body's distal or forward end is configured to receive and support a removable bolt head 330 including at least first and second transversely projecting bolt lugs. Bolt head 330 preferably has a rear extension fabricated about its exterior to intimately fit into the bolt body and defines two female helical cam surfaces as well as two detent slots, all running perpendicular through the thickness and correctly oriented by the parallel flats of the rear extension. Attachment of the Bolt Head to the Bolt Body is completed by two parallel cross-pins pressed into place, both contained along the forward walls of the Bolt Body, traversing through radial-bottomed slots running parallel to each other and along the rear flats of the Bolt Head. Upon assembly for operation in the rifle, rotating bolt assembly 370 from a closed position to an open position rotates the Bolt Body and attached Bolt Head 330 and actuates the bolt assembly. The Bolt Head 330 further comprises just forward of the shoulder that mates to the front face of the Bolt Body a reduced diameter section to allow clearance when inserting the Bolt Head into the rear of the barrel extension member 400. Protruding forward from this reduced diameter of the Bolt Head are, preferably, three transversely projecting locking lugs having rear lug surfaces of a conical shape to mate to the conical lug seats or bearing surfaces 420 LBS of barrel extension member 400 when rotated into battery as described above. The shape of the three locking lugs of Bolt Head 330, matching with proper clearance the interior shape at the rear of the barrel extension member 400, allow Bolt Head 330 to move rearward unrestricted by and without upsetting a top most cartridge present in magazine box assembly 390, while also performing correct feeding of the top cartridge upon the return forward movement of the Bolt Head. One of the two remaining locking lugs of the Bolt Head is oriented towards the ejection side of the receiver assembly 212 with the other slightly opposite towards the top, both protruding outward from center-line beyond the outside diameter of the Bolt Body, and are both of a radial shape to facilitate the economical fabrication of the required "race-ways" into receiver 212. To compensate for the reduction in surface area of the bottom "flush" locking lug compared to the other two protruding locking lugs, the bottom locking lug presents a wider surface, simultaneously facilitating more reliable feeding of cartridges. Allowing for the wider surface area of the bottom locking lug, the orientation of the two remaining locking lugs are arranged to optimize surface contact of all three locking lugs once in battery.

Figure 10:
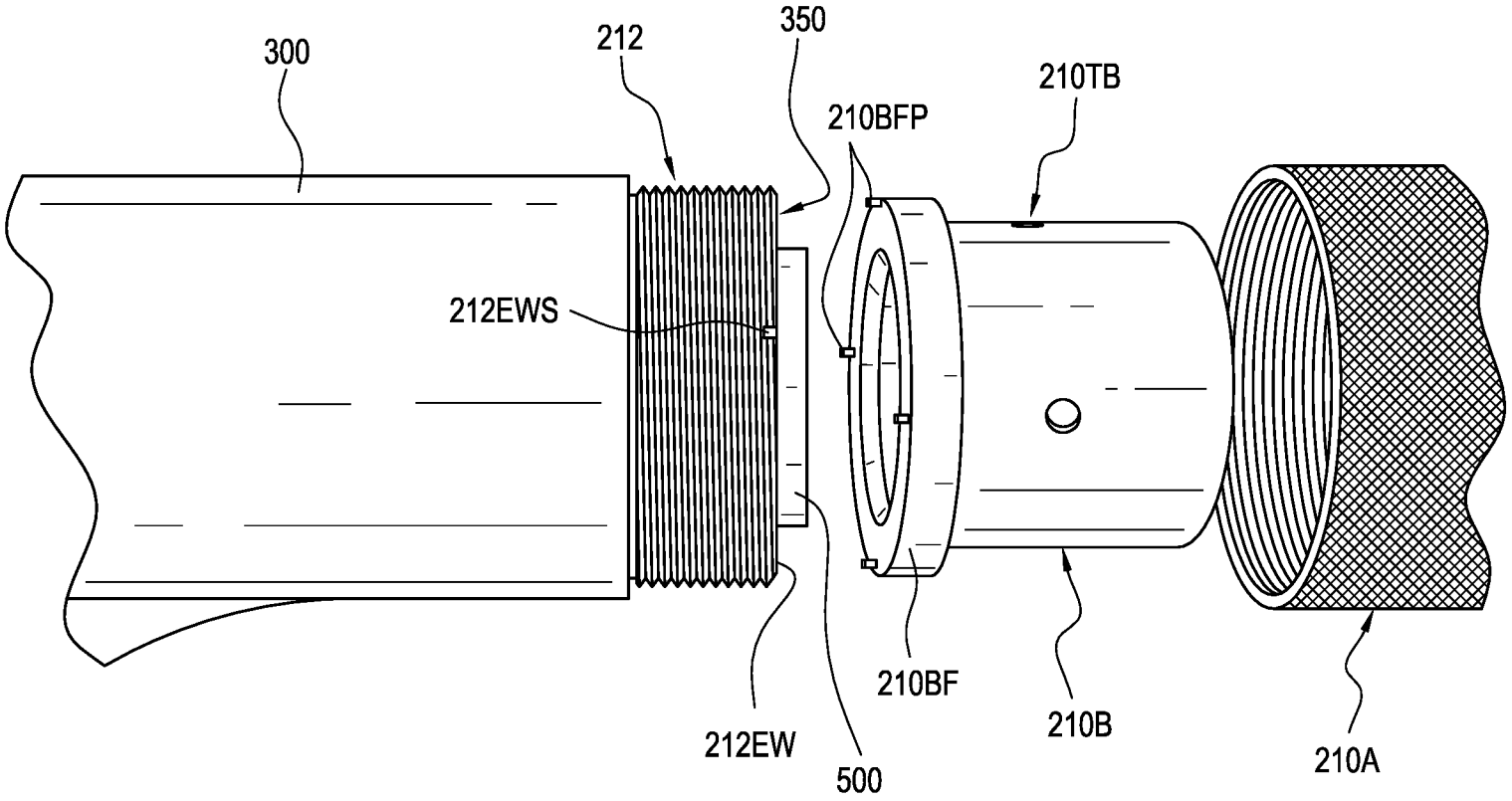
FIG. 10 is a disassembled side view in elevation of the receiver subassembly and forearm subassembly of FIGS. 2, 3, and 5-9, in accordance with the present invention.
Figure 11:
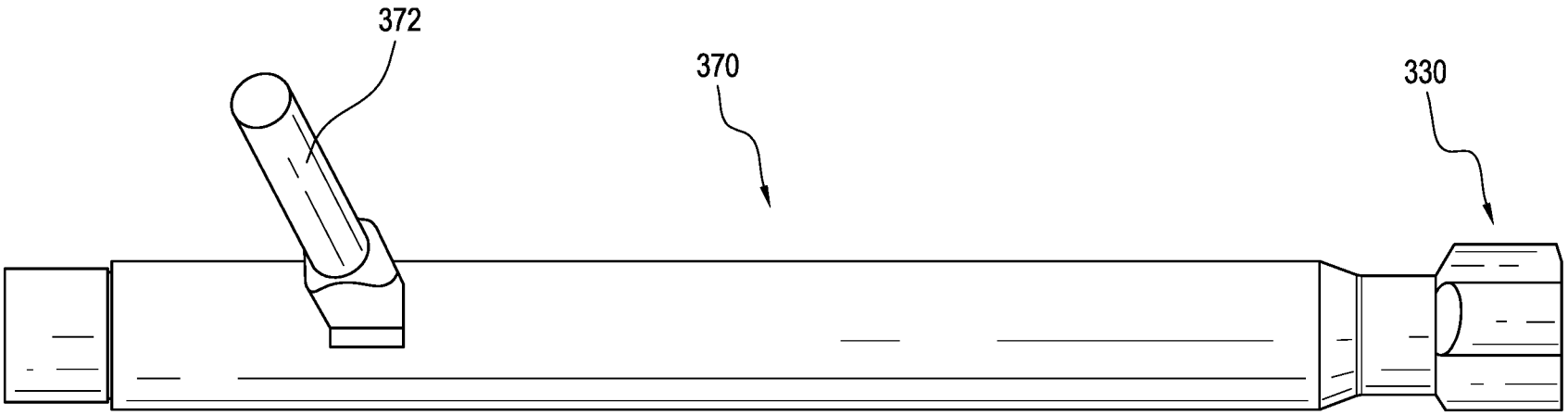
FIGS. 11 and 12 are views of the bolt assembly configured for use with the receiver subassembly of FIGS. 2 and 3, in accordance with the present invention.
Figure 12:
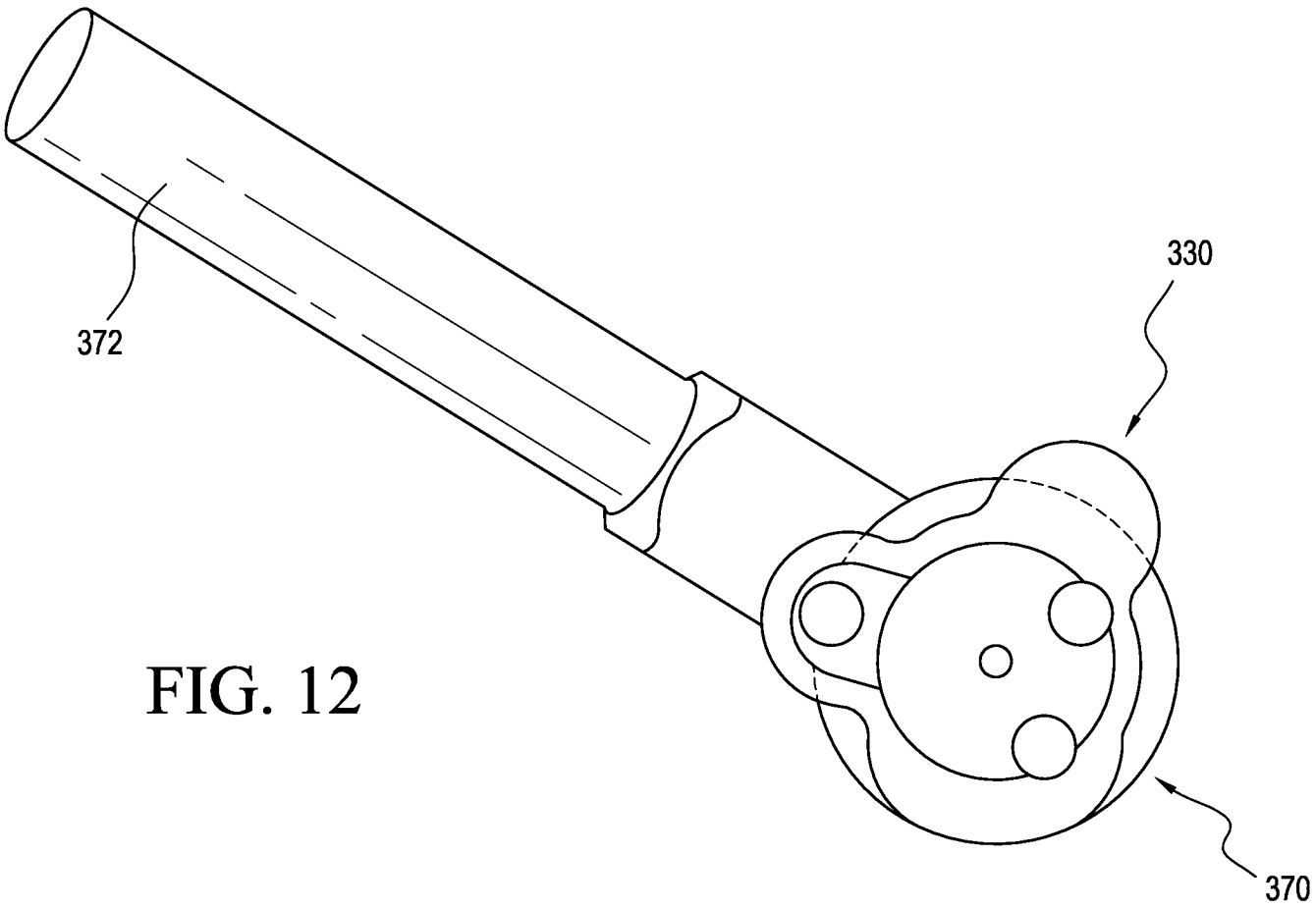

Turning again to FIGS. 2, 3 and 6-10, parts of the barrel mounting interface and fore-end assembly 200 are shown disassembled into three coaxially aligned components, including the main forend tube member 216 defining cylindrical sidewall 220, and proximal threaded collar assembly 210 which comprises forend tube nut 210A and forend tube extension 210B. As noted above, forend tube nut 210A preferably has a knurled external sidewall and internal threads which are configured to engage and hold the distal-end external threads of receiver 212 (as best seen in FIG. 10). Forend tube nut 210A has a cylindrical sidewall having an open proximal lumen with proximal end which defines an annular proximal end wall which is tightened proximally, where it may be drawn proximally and limited in proximal engagement by forcing the self-centering exterior frusto-conical surface of receiver barrel coupler/nut or barrel retaining nut 500 against the corresponding interior frusto-conical abutment surface defined on the distal end of barrel extension member 400 when it is inserted within and supported by receiver 212, and when forend tube nut 210 is affixed thereupon. Prior to assembly and installation, the rifle's barrel subassembly 214 is aligned with the central axis 300CA at the distal end of receiver 212 and once the receiver barrel coupler/nut or barrel retaining nut 500 has been torqued in place, the components of forend assembly 200 are aligned coaxially with the barrel subassembly 214.

It will be apparent to persons of skill in the art that the present invention makes available a novel modular precision rifle assembly 150 configured to allow users to change barrels 216 (e.g., for a replacement barrel for use with the same ammunition or a barrel configured for shooting a different ammunition caliber or type), comprising the following features: (a) a receiver subassembly 212 comprising a receiver housing 300 having a proximal open end and a distal open end connected by central lumen defining a plurality of substantially cylindrical contiguous cavities having selected inside diameters, said contiguous cavities being aligned along a central axis 300CA;

(b) wherein said receiver housing has a threaded outside diameter proximate its distal end and said central lumen terminates distally in a first distal coupler-nut receiving cavity having a first larger inside diameter and threaded interior;

(c) wherein said receiver housing central lumen has a second barrel extension receiving cavity which is coaxially aligned with and terminates distally in said first distal coupler-nut receiving cavity, wherein said second barrel extension receiving cavity has a second inside diameter which is smaller than said first cavity's first inside diameter and, wherein said second barrel extension receiving cavity has a smooth cylindrical interior surface which terminates proximally in a transverse annular bearing surface 352;

(d) wherein said receiver housing central lumen has a coaxially aligned proximal lumen section configured to receive a coaxially aligned bolt assembly insertable via said receiver housing's open proximal end; and (e) wherein said receiver housing central lumen second barrel extension receiving cavity is configured to receive a barrel extension member 400 with an internal lumen having a distal section adapted to be threaded or affixed to a barrel tenon and also defines a plurality of bolt locking lug bearing surfaces 420 LBS;

(f) a barrel subassembly 214 including a barrel 216 carrying an affixed barrel extension member 400;

(g) wherein said barrel extension member 400 has a distal end wall segment or flange which defines a first distal centering force generating surface 410;

(h) a receiver barrel coupler/nut or barrel retaining nut 500 including a threaded outside diameter surface 530 configured to be received and removably fastened within said receiver housing central lumen's distal coupler-nut receiving cavity threaded interior; and (i) wherein said receiver barrel coupler/nut or barrel retaining nut 500 terminates in a proximal angled end wall segment defining a second centering force generating surface 520 configured to axially align with, engage and apply centering force to said barrel extension's first distal centering force generating surface 410.

The modular precision rifle assembly 150 illustrated in FIGS. 2-12 preferably has barrel extension first distal centering force generating surface 410 configured as an angled frustoconical section or shoulder surface having a selected exterior angle 410EA of about 250 degrees. So the retaining nut's second centering force generating surface 520 is an inwardly angled frustoconical section or surface having a selected interior angle 520IA of about 110 degrees. Optionally, as noted above, the barrel extension's first distal centering force generating surface 410 could be defined as a convex section (not shown) configured to cooperate with and generate centering force against a coupler nut's cooperating proximal concave section (not shown). The forend subassembly 200.

The modular precision rifle assembly 150 is preferably configured to allow users to align barrels 216 using the alignment feature 430 defined in transverse proximal end wall 440 (e.g., the transverse half-moon or semi cylindrical alignment groove 430 defined from the smooth sidewall radially into the barrel extension end wall surface 440, and the receiver housing's second barrel extension receiving cavity is configured with an inwardly projecting transverse pin 354 configured to fit within and radially index the barrel extension member 400 within the second barrel extension receiving cavity. As noted above and illustrated in FIGS. 2-14, modular precision rifle assembly 150 is configured to allow users to change barrels 216. The receiver housing's central lumen second barrel extension receiving cavity (which receives barrel extension 400) and the first distal internal threaded coupler-nut receiving cavity are coaxially aligned with the bore axis of barrel 216 when barrel coupler nut 500 is tightened within said first cavity's threaded surface to force said barrel extension's transverse proximal end wall 440 against said receiver housing's second barrel extension receiving cavity transverse annular bearing surface 352 with enough force to safely contain any pressure created within the barrel's chamber while firing (e.g., when barrel coupler nut 500 is torqued against action wrench 390 (and thus barrel extension bearing surfaces 420 LBS) by a selected barrel tightening torque (in the range of 50-100 ft lbs).

Having described and illustrated preferred embodiments of a new and improved modular precision rifle assembly 150 and method for configuring rifle components, it is believed that other modifications, variations and changes will be suggested to those skilled in the art in view of the teachings set forth herein. It is therefore to be understood that all such variations, modifications and changes are believed to fall within the scope of the claims appended hereto.

I claim:

1. A modular precision rifle assembly configured to allow users to change barrels, comprising: a receiver subassembly comprising a receiver housing having a proximal open end and a distal open end connected by central lumen defining a plurality of substantially cylindrical contiguous cavities having selected inside diameters, said contiguous cavities being aligned along a central axis; wherein said receiver housing has a threaded outside diameter proximate the distal end and said central lumen terminates distally in a first distal coupler-nut receiving cavity having a first larger inside diameter and threaded interior; and wherein said receiver housing central lumen has a second barrel extension receiving cavity which is coaxially aligned with and terminates distally in said first distal coupler-nut receiving cavity, wherein said second barrel extension receiving cavity has a second inside diameter which is smaller than said first cavity's first inside diameter and, wherein said second barrel extension receiving cavity has a smooth cylindrical interior surface which terminates proximally in a transverse annular bearing surface; and wherein said receiver housing central lumen has a coaxially aligned proximal lumen section configured to receive a coaxially aligned bolt assembly insertable via said receiver housing's open proximal end; and wherein said receiver housing central lumen second barrel extension receiving cavity is configured to receive a barrel extension member with an internal lumen having a distal section adapted to be threaded or affixed to a barrel tenon and also defines a plurality of bolt locking lug bearing surfaces.

2. The modular precision rifle assembly configured to allow users to change barrels of claim 1, further comprising: a barrel subassembly including a barrel carrying an affixed barrel extension member; wherein said barrel extension member has a distal end wall segment or flange which defines a first distal centering force generating surface.

3. The modular precision rifle assembly configured to allow users to change barrels of claim 2, further comprising: a receiver barrel coupler/nut or barrel retaining nut including a threaded outside diameter surface configured to be received and removably fastened within said receiver housing central lumen's distal coupler-nut receiving cavity threaded interior; wherein said receiver barrel coupler/nut or barrel retaining nut terminates in a proximal angled end wall segment defining a second centering force generating surface configured to axially align with, engage and apply centering force to said barrel extension's first distal centering force generating surface.

4. The modular precision rifle assembly configured to allow users to change barrels of claim 3, wherein said barrel extension's first distal centering force generating surface is an angled frustoconical section or shoulder surface having a selected exterior angle of about 250 degrees.

5. The modular precision rifle assembly configured to allow users to change barrels of claim 4, wherein said retaining nut's second centering force generating surface is an inwardly angled frustoconical section or surface having a selected interior angle of about 110 degrees.

6. The modular precision rifle assembly configured to allow users to change barrels of claim 3, wherein said barrel extension's first distal centering force generating surface is defined as a convex section configured to cooperate with and generate centering force against a coupler nut's cooperating proximal concave section.

7. The modular precision rifle assembly configured to allow users to change barrels of claim 1, further comprising: forend subassembly configured with a forend tube nut s having a threaded inside diameter surface for releasable engagement with said receiver housing's threaded outside diameter proximate its distal end.

8. The modular precision rifle assembly configured to allow users to change barrels of claim 3, wherein said barrel extension has a transverse proximal end wall with a transverse half-moon or semi cylindrical alignment groove defined from said smooth sidewall radially into said barrel extension end wall surface, and wherein said receiver housing's second barrel extension receiving cavity is configured with an inwardly projecting transverse pin configured to fit within and radially index the ember within said second barrel extension receiving cavity.

9. The modular precision rifle assembly configured to allow users to change barrels of claim 8, wherein said receiver housing central lumen second barrel extension receiving cavity and said first distal coupler-nut receiving cavity are coaxially aligned with the bore axis of said barrel, when said is tightened within said first cavity's threaded surface to force said barrel extension's transverse proximal end wall against said receiver housing's second barrel extension receiving cavity transverse annular bearing surface.

* * * * *